United States Patent [19]

Engle

[11] Patent Number: 4,718,351

[45] Date of Patent: Jan. 12, 1988

[54] ARTICULATED COUPLING FOR INTEGRAL TRAINS

[75] Inventor: Thomas H. Engle, Cape Vincent, N.Y.

[73] Assignee: General Signal Corporation, Stamford, Conn.

[21] Appl. No.: 853,562

[22] Filed: Apr. 18, 1986

Related U.S. Application Data

[63] Continuation-in-part of Ser. No. 776,764, Sep. 16, 1985, abandoned.

[51] Int. Cl.[4] ..... B61F 3/12; B61F 5/14; B61G 5/02

[52] U.S. Cl. ..... 105/4.3; 105/199.3; 105/199.4; 105/422; 213/75 R; 213/24; 280/511

[58] Field of Search ..... 280/433, 432, 446 R, 280/511; 105/3, 4.1, 4.3, 199.3, 199.4, 414, 422; 410/64; 213/24, 62 A, 75 R

[56] References Cited

U.S. PATENT DOCUMENTS

| | | | |
|---|---|---|---|
| 1,901,675 | 3/1933 | Sundholm | 105/4.1 |
| 2,093,761 | 9/1937 | Kramer | 280/511 X |
| 2,104,840 | 1/1938 | Stucki | 105/4.1 |
| 2,130,100 | 9/1938 | Rasmussen | 280/511 |
| 2,687,099 | 8/1954 | MacVeigh | 105/4.3 |
| 2,753,811 | 7/1956 | Walker | 105/4.3 |
| 2,893,326 | 7/1959 | Browne et al. | 105/4.3 |
| 2,908,229 | 10/1959 | Furrer | 105/3 |
| 3,102,613 | 9/1963 | Johnston | 105/422 X |
| 3,290,058 | 12/1966 | Ellerd | 105/4.1 X |
| 3,295,463 | 1/1967 | Barber | 105/199.3 |
| 3,994,510 | 11/1976 | Howard | 280/432 |
| 4,191,107 | 3/1980 | Ferris et al. | 105/4.1 |
| 4,275,663 | 6/1981 | Sivachenko et al. | 105/414 X |
| 4,315,465 | 2/1982 | Cordani et al. | 105/4.1 |

*Primary Examiner*—Robert B. Reeves
*Assistant Examiner*—Scott H. Werny
*Attorney, Agent, or Firm*—Barnes & Thornburg

[57] ABSTRACT

An articulated coupling having a center coupling and a plurality of side bearings or couplings coaxial along a lateral axis to facilitate yaw and pitch between two cars while restricting roll. The side bearings each have a cylindrical member on one car received in a cylindrical recess associated with another car. The center coupling includes a mating of two spherical members with one of the member longitudinally movable to allow pitch. The axes of the cylindrical side bearings are coaxial and include the center of the spherical center coupling.

28 Claims, 8 Drawing Figures

ARTICULATED COUPLING FOR INTEGRAL TRAINS

This is a continuation-in-part of U.S. Ser. No. 776,764 filed Sept. 16, 1985, now abandoned, of which the following is a specification.

BACKGROUND AND SUMMARY OF THE INVENTION

The present invention relates generally to an improved train, and more specifically to articulated couplings between the cars of integral trains and an intermodal integral train for transporting highway vehicles having their own wheels or other types of loads, without wheels, such as containers.

The design of special cars to be used in a railroad system to carry containers or trucks or truck trailers have generally been modifications of existing railroad stock. These systems have not been designed to operate in the normal railway environment which imposes shock leads on the cars during switching and operating periods, and thus, have not taken advantage of the fact that these lighter loads could be designed for if cars were never uncoupled for switching operations. The economy and operation of the lighter weight trains that could thus be designed, as well as economies in the cost of original material were not taken into account.

An integral train can be made up of a number of subtrains called elements. Each element consists of one or two power cabs (locomotives) and a fixed number of essentially permanently coupled cars. The cars and power cabs are tightly coupled together in order to reduce the normal slack between the cars. The reduction of the slack results in a corresponding reduction in the dynamic forces which the cars are required to withstand during the run in and out of the train slack. The reduction of the dynamic forces allows for the use of lighter cars, which allows for an increase in the cargo weight for a given overall train weight and therefore an increase in train efficiency. Additional improvements in efficiency were to be obtained through the truck design and from other sources.

A complete train would consist of one or more elements. The elements could be rapidly and automatically connected together to form a single train. It is expected that in certain cases elements would be dispatched to pick up cargo and then brought together to form a single train. The cargo could then be transported to the destination and the elements separated. Each element could then deliver its cargo to the desired location. Each element would be able to function as a separate train or as a portion of a complete train. The complete train could be controlled from any element in the train. The most likely place for control would be the element at the head end of the train, but it was anticipated that under circumstances such as a failure in the leading unit, the train would be controlled from a following element.

Federal Regulations require brake inspections whenever a train is made up and periodically during its operation. The inspection Procedure involves the application and release of the train brakes and an inspection of each car on the train to verify that the brakes function as expected. This process is very time consuming. The communications cable running through the train makes it possible for the control system automatically and rapidly to perform the brake inspection.

It is well known that when trains go around a sharp curve, the railroad truck must rotate relative to the body to allow the train to negotiate the curve. Various railroad truck constructions have been provided to allow this to happen. Similarly, articulated couplings have been provided between cars to help steer the railroad cars around the turns. These generally have included adjustable linkages connecting the cars to each other and laterally displaced to complementarily elongate and contract. In some trains, a common railroad truck has been provided between adjacent cars which constitutes the articulated coupling. The cars are joined to the truck to pivot at a point along their longitudinal axis and rods are provided at both ends of the truck and connected to each of the cars such that the axle of the truck bisects the angle defined by the adjacent lateral axis of the adjacent cars.

Although these systems have been designed for yaw or rotation about the vertical axis defined by the pin connection therebetween, and for pitch or rotation about the lateral axis due to height variations along the longitudinal axis of the track, but they have not been designed to limit roll or rotation about the longitudinal axis at the articulated coupling. Prior art articulated couplings have a male member received longitudinally in a female member and a vertical pin inserted. The longitudinal stress on the coupling has to be relieved before the pin can be removed for decoupling.

Thus, it is an object of the present invention to provide an articulated coupling which facilitates yaw and pitch while limiting roll.

Another object of the present invention is to provide a uniquely designed train system to accommodate containers, trucks and truck trailers.

A further object of the present invention is to provide an articulated joint which is easily decoupled.

Yet another object of the present invention is to provide a unique car structure which is essentially a continuous platform.

A still further object of the present invention is to provide a slack-free, wear self-compensating coupling between cars.

These and other objects of the invention are attained by providing a central coupling and one or more pairs of pivoted side bearings or couplings spaced along the lateral axis of the cars. The central coupling is at the longitudinal axis of the car and between two side bearings which are laterally spaced therefrom. The central coupling which is mated at adjacent ends of adjacent cars to transmit draft forces, facilitate the pivoting of the cars relative to each other about a vertical axis at the first coupling or yaw, facilitate pivoting about a lateral axis at the coupling or pitch and permit relative roll motion. The pivoted side bearings, however, restrict pivoting about the longitudinal axis or roll facilitating yaw and pitch. Thus, in totality the coupling system components cooperates to facilitate Yaw and pitch while restricting roll.

The preferred structure of the side bearings, includes a cylindrical female member coaxial with the lateral axis of the body and a male member having a concave surface for receiving the respective female members. While the female members are fixed to one end of the body, the male members contact a horizontal surface on the other end of the body to move on the body and allow the male members to be coaxial with the axis of the mating female members of an adjacent car. Each pair of side bearings include structure which maintains the respective male members coaxial along an axis parallel to the axis of the female members of the adjacent car during mating. This structure includes side faces on the male and female members spaced along the lateral axis so as to engage during mating to produce the alignment.

The male and female members of the central coupling, which is on the longitudinal axis, have mating spherical surfaces to faciliate pivoting about the vertical axis. The center of these coincident spherical surfaces is on the axis of the side cylindrical part of the side bearings. The female member of the central coupling includes a pair of collars, one of which moves along the longitudinal axis in a direction to tighten the spherical female surface formed between the two yokes to maintain close clearance in the central coupling. Since the central coupling is the only coupling which must be opened to permit the separation of cars, the cars are readily separated or assembled by disassembling only the central coupling.

Other objects, advantages and novel features of the present invention will become apparent from the following detailed description of the invention when considered in conjunction with the accompanying drawings.

DETAILED DESCRIPTION OF THE DRAWINGS

Figure 1:
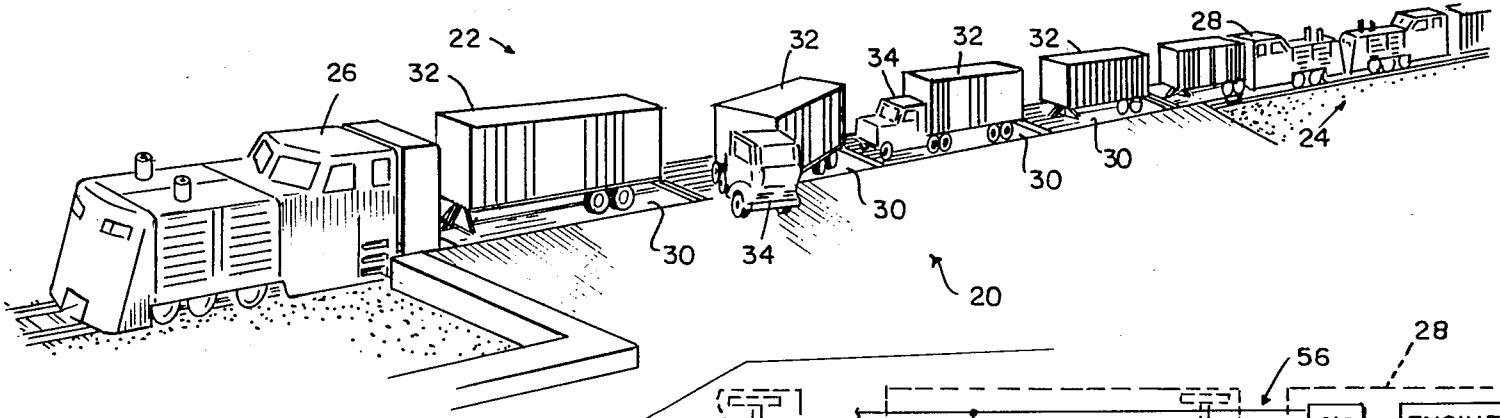
FIG. 1 is a perspective view of an integral train incorporating the principles of the present invention.

As illustrated in FIG. 1, a train 20 includes a plurality of train sections 22 and 24 which represent one of a plurality of train sections. Each section includes a pair of control cabs 26 and 28 at each end of the section. Note that conventional locomotives could be used at these locations. As will be explained in more detail below, one of the control cabs has controls set to "LEAD" and will accept commands from an operator, while the other has its controls set to "TRAIL" and the controls are interconnected to provide the appropriate control of the propulsion and braking system. Connected between the two control cabs 26 and 28 is a plurality of cars 30 forming a continuous deck. The deck is structured such that loads for example, trailers 32 may be secured to the cars 30 on a specific car or across the juncture of a pair of cars. The trailers 32 may be secured by themselves or in combination with the tractors 34. By providing a continuous decking, the train 20 can be side loaded from a flush platform. This allows simultaneous loading of trucks, thus eliminating the necessity to wait for a loading crane, or for a truck occupying a different position to be loaded.

Figure 2:
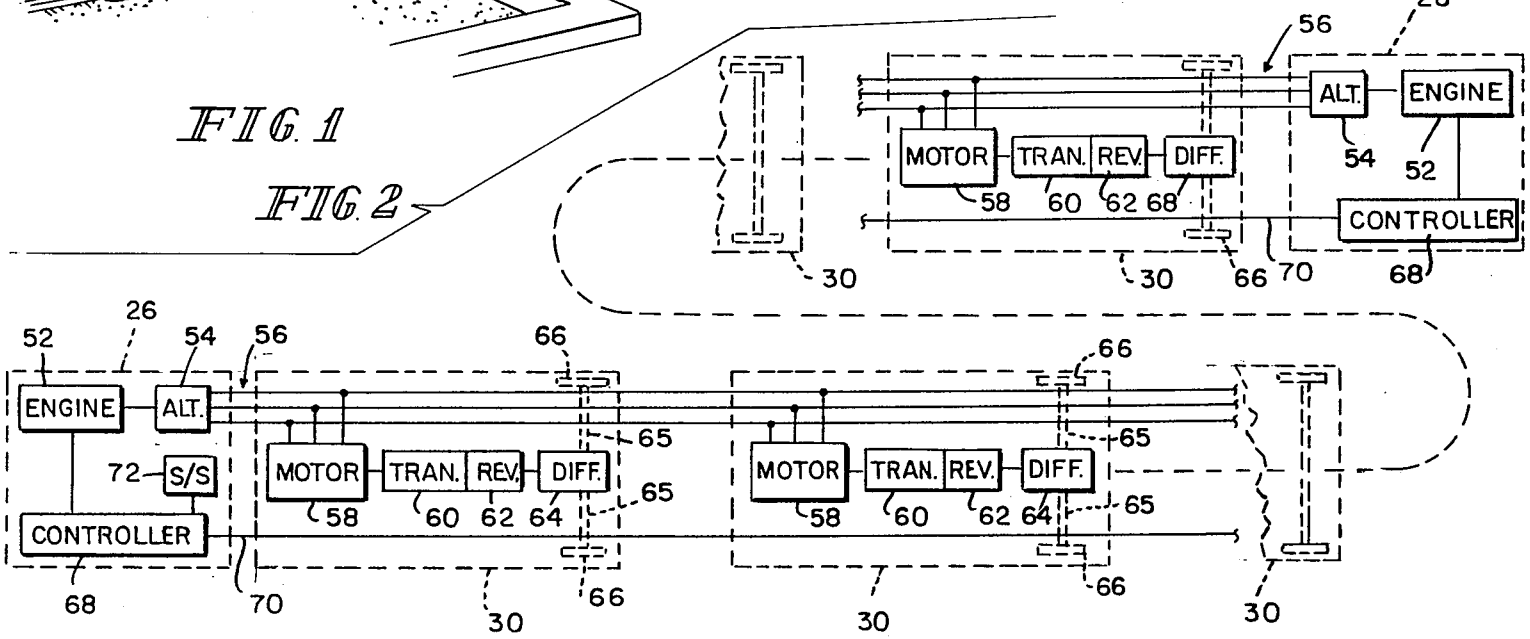
FIG. 2 is a block diagram of a propulsion system incorporating the principles of the present invention.

The control cabs 26 and 28 need not be locomotives in the conventional sense. The propulsion system 50 is considered a distributive propulsion system as illustrated in FIG. 2. The control cabs 26 and 28 include a mechanical engine 52 driving an electrical alternator 54. The output of the alternator 54 is three phase current whose frequency and voltage are a function of the speed of the engine 52. This current is transmitted down a three phase wire system 56 to a plurality of electric motors 58 distributed throughout the cars 30. Each of the electric motors 58 are connected to a respective automotive-type automatic transmission 60 with fluid coupling which includes a directional control reversing gear 62. The output of the directional control reversing gear drives a differential 64 to which a pair of axles 65 and wheels 66 are connected. Each of the control cabs 26 and 28 include a controller 68 which can control the speed of all of the engines based on a throttle setting selected by the operator in one cab. The controller 68 also provides control signals via line 70 to the transmission 60 and the reversing gear 62. A train speed sensor 72 on a non-powered axle provides an input signal to controller 68. The controller 68 selects the gears of the transmission and the shift points as a function of the measured speed of the train and the throttle setting.

For a 1,050 foot train element the five cars 30 adjacent to each of the control cabs 26 and 28 include the motor, transmission, reversing gear and differential.

Making the train as light as possible allows the use of lighter motive power systems. The engine 52 can be an automotive engine such as a 525 HP General Motors 12 Cylinder or a 750 HP General Motor 16 Cylinder V72 two stroke cycle diesel engine. These are standard engines used on highway trucks. The engines 52 will drive a 600 kilowatt alternator 54 at variable speeds from 500 to 2,000 RPM's producing a three phase current from 15 to 66 hertz and up to 480 volts. As will be explained below, the schematic of FIG. 2 includes a pair of engines 52 and a pair of alternators 54 therefore there is approximately 1,500 horsepower available at each end of the train element. The electric motors 58 in the cars 30 may be a 300 HP squirrel cage induction motor with an Allison MT644 automatic transmission. The controller 68 would receive an input from the operator which could be the standard eight step engine speed signal for rail locomotives. A speed governor is provided which limits the engine speed 52 based on the position of the eight step controller, and advances the engine's injector racks to a point corresponding with that fraction of full rack position called for by the engine means master controller. Thus, throttle 1 position would move the racks $\frac{1}{8}$ of the distance between idle and full rack and would limit engine speed to a maximum of idle speed plus $\frac{1}{8}$ of the difference between idle speed and maximum permissible engine speed. Throttle 2 would increase these settings to 2/8 full rack increase and 2/8 speed movement and so forth so that in throttle 8 the engine would be permitted to run at maximum possible speed, and would be given full rack at any speed lower than this.

The regulation of train speed at the wheel 66 for any given speed of engine 52 will be determined by gear changes in the automatic transmission in combination with the three phase electrical signal provided by alternator 54 to the individual motors 58. While the gear selection for the automatic transmission 60 will be governed by train speed and power setting from controller 68, the hydro-dynamic torque converter will make up for both torque demand and wheel diameter differences to permit the full power from the electric motor 58 to be converted to appropriate torque at the wheel. Increasing loads on the wheels brought about by, for example the train slowing on a grade, will cause increased torque converter slip, increased electrical slip and if engine speed falls to low, an automatic transmission downshift. All three of these will increase the torque to balance the road load requirement. Thus, the transmission will automatically adapt itself to load changes brought about by changes in terrain or throttle setting. The controller 68 will govern the transmission shift points in accordance with both train and engine speed in accordance with a predetermined operating program. Train speed will be determined by sensor 72 measuring the speed of a non-powered axle. As train speed picks up, the transmission will unload, decreasing torque and allowing engine speed to increase which permits the transmission to automatically upshift. This maintains engine load essentially constant. When the train speed nears synchronism with the engine RPM in the top transmission gear, torque demand and engine load will be balanced and the engine governor will reduce fuel to limit engine speed to its preselected value.

As can be seen, the propulsion system has been distributed over two cabs and ten cars per element. In prior art diesel electric locomotives, the propulsion is concentrated in the locomotives which have had weight or ballast added to increase traction. Thus, the train is carrying and must be designed for non-revenue weight. The present train uses the weight of the freight as ballast on the cars with powered axles and, thus, reduces the weight of the cab and powered cars.

The prior art transmission system includes a generator driven at engine speed which feeds power to an electric traction motor connected to the axle through gears. The traction motors must be designed for high torque during train start up and include current measuring and limiting devices to minimize traction motor overheating at low speeds. These systems also include switching and control circuits to accommodate the increase and high voltages at high speeds. The present transmission system uses a truck automatic transmission between the a conventional AC squirrel cage motor and the axle and drives commercially available 60 Hz motors with three phase power lines at engine shaft speed. Thus, special electric motors, special generators and complicated switch gears are eliminated.

Figure 3:
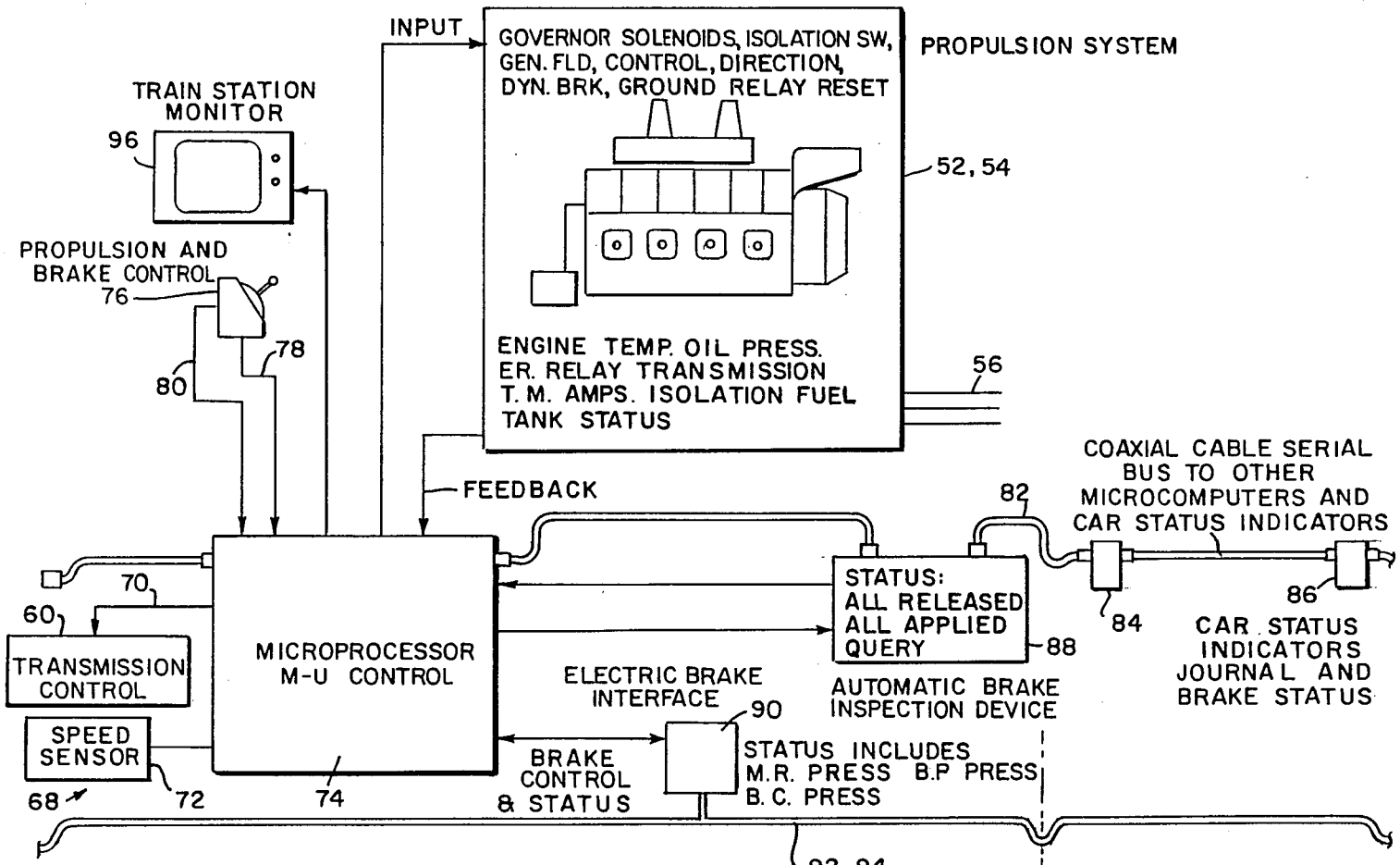
FIG. 3 is a block diagram of a control system incorporating the principles of the present invention.

A more detailed schematic of the control system in the control cab is illustrated in FIG. 3. The controller 68 includes a microcomputer controller 74 which is connected to the manual master propulsion and brake control 76 which provides propulsion control signals for the eight propulsion settings over line 78 and the brake control signals over line 80. These are electrical signals provided to the microprocessor. The electric signals from control element 76 are converted to throttle position signals to the engine governor 52. These signals generally include the A, B, C and D command signals, identical with conventional locomotive governor solenoid control signals and other elements of the motor control which are well known in the art. The condition of the engine and alternator are fed back to the microcomputer controller 74.

The microprocessor based controller 74 is connected throughout the train element to each of the individual cars 30 and to the microcomputer controller in the other cab which forms a train element by a coaxial cable serial bus 82. Connected in each of the cars to the serial bus 82 are journal bearing heat detectors 84 and brake status detectors 86. A bearing status and brake application query circuit 88 may include a tone generator and driver which applies a specific tone to the coaxial serial bus 82. The heat sensor 84 and the brake sensor 86 could include tuned devices which will cause the transmission line to be essentially shorted at a specific frequency. Thus, when the tone generator at one end transmits a signal at that frequency, it will be propagated to the other end with little attenuation if there is not a hot journal bearing and the brakes are not applied. If hot condition exists or the brakes are applied on any car during a test sequence somewhere between the transmitter and receiver, the signal will be substantially attenuated and this condition would be sensed and reported at the receiving end.

Since a hot journal or a locked, dragging or not fully released brake are considered unsafe conditions, a single frequency signal and same frequence tuned detectors may be used for both. If differentiation of unsafe conditions is necessary as to type, namely hot journal or brake, or specific car, each tuned detector could have a separate frequency and the query circuit would sequentially transmit the various frequencies.

Each control message will include check words which will be used at the receiving end to reject messages which have been corrupted during transmission. In the event that an erroneous message does pass this test and is accepted, the frequency of control message transmissions will make the reception of two or more identically erroneous control messages extremely improbable. The hardware which activates the controls at each unit is sufficiently slow, that a single erroneous message will not be applied long enough to affect train operation. Finally, there are both software and hardware interlocks to insure that controls cannot be manipulated in an illogical manner. For example, it will be checked both in hardware and software that a reversal of operating direction can only be made with the engine at idle. In the more likely case of one or more consecutive control messages being rejected because of detected errors, the affected power unit would be allowed to continue operating on the basis of its last valid control message, either until it receives a new valid control message, or until a specified period of time had elapsed. In the latter case, the affected power unit would be forced to a known state until communications are restored.

A brake status and control unit 90 is connected electrically to the microcomputer 74 and fluidically to main reservoir pipe 92 and brake pipe 94. The brake control and status unit 90 provides an indication to the microprocessor of the status of the main reservoir pressure, the brake pipe pressure and the brake cylinder pressure. The control outputs of the brake control and status 90 are three electrically operated main valves to provide service brake application, release, and emergency brake applications through the brake pipe as well as dynamic braking control and feedback signals. Electro-pneumatic brake systems are well known and, thus, the operation of brake control and status 90 need not be provided in detail.

By providing a control cab at each end of an element facing in opposite directions, a train can be made up from individual elements without concern as to the direction the element is headed. As an alternative, the element may be direction specific with a powered control cab at one end and a powerless control cab or module at the other end. The powerless control cab would contain the same electronics and control hardware as the powered control cab except for interface to an operator and controls and sensors for the propulsion system.

Figure 4:
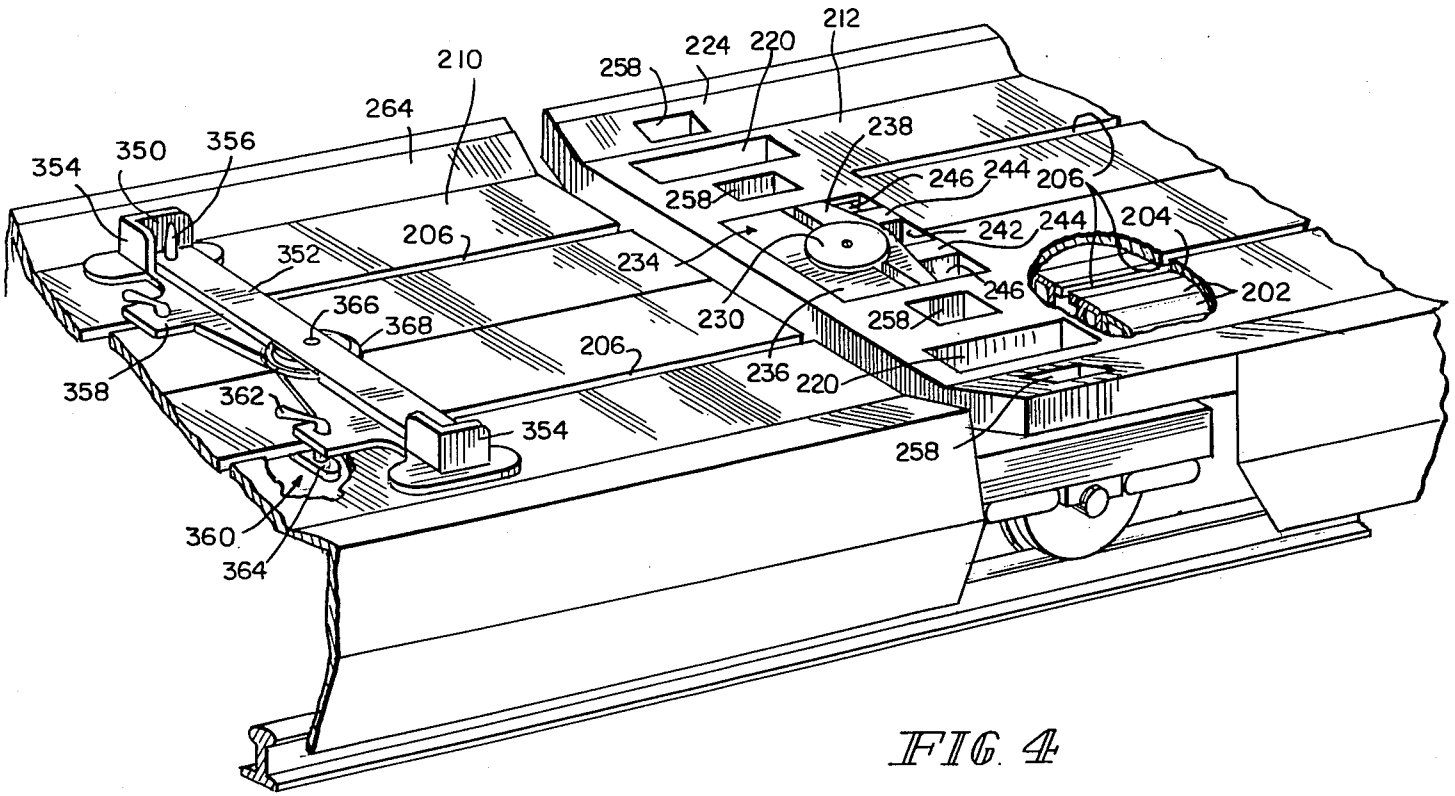
FIG. 4 is a perspective view of a pair of cars and a container hold down device incorporating the principles of the present invention.

The individual platform or cars 30 of the train make up a continuous deck running for a length of approximately 1,000 feet constituting approximately 42 cars. The deck arrangement over the to-be-discussed articulated single axle is such that a truck can be driven onto it from the side and "parallel parked" upon it. The short platform reduces both relative angular motion of the platform as the train rounds a curve and vertical bending to much lower values than those experienced on conventional trains. The deck of the car 30 consists basically of a series of welded extrusions 202 on a frame and connected by welded plate sections 204 as shown in FIG. 4. The welds are located away from the high stress areas so as to minimize cost and maximize safety and reliability. This construction allows a stiff deck to be combined with a very low cost lightweight deck. A pair of deck length T slots 206 are provided to which container mounting devices may be engaged at any point as will be discussed below. The deck length T's are open on the bottom through elongated holes so as to be self-cleaning under all weather conditions.

The car 30 has a wheeled end 210 and a wheelless end 212. Thus, each car only has a single axle and is supported at its wheelless end 212 by the axle of the adjacent car. The end structure which extends over the wheels at the wheeled end 210 includes an end under frame that is constructed and welded to the main frame. The wheelless end 212 also includes an underframe which is welded to the main frame. The wheelless end 212 overlaps the wheeled end 210 to form a continuous platform. Mating elements in the overlapping end structure forms an articulated coupling which is slack-free and self-compensating for wear. The deck and frame at the wheeled end 210 has a pair of recesses 218 to receive wheels 66 and wheelless end 212 includes a corresponding pair of recesses 220.

Figure 5:
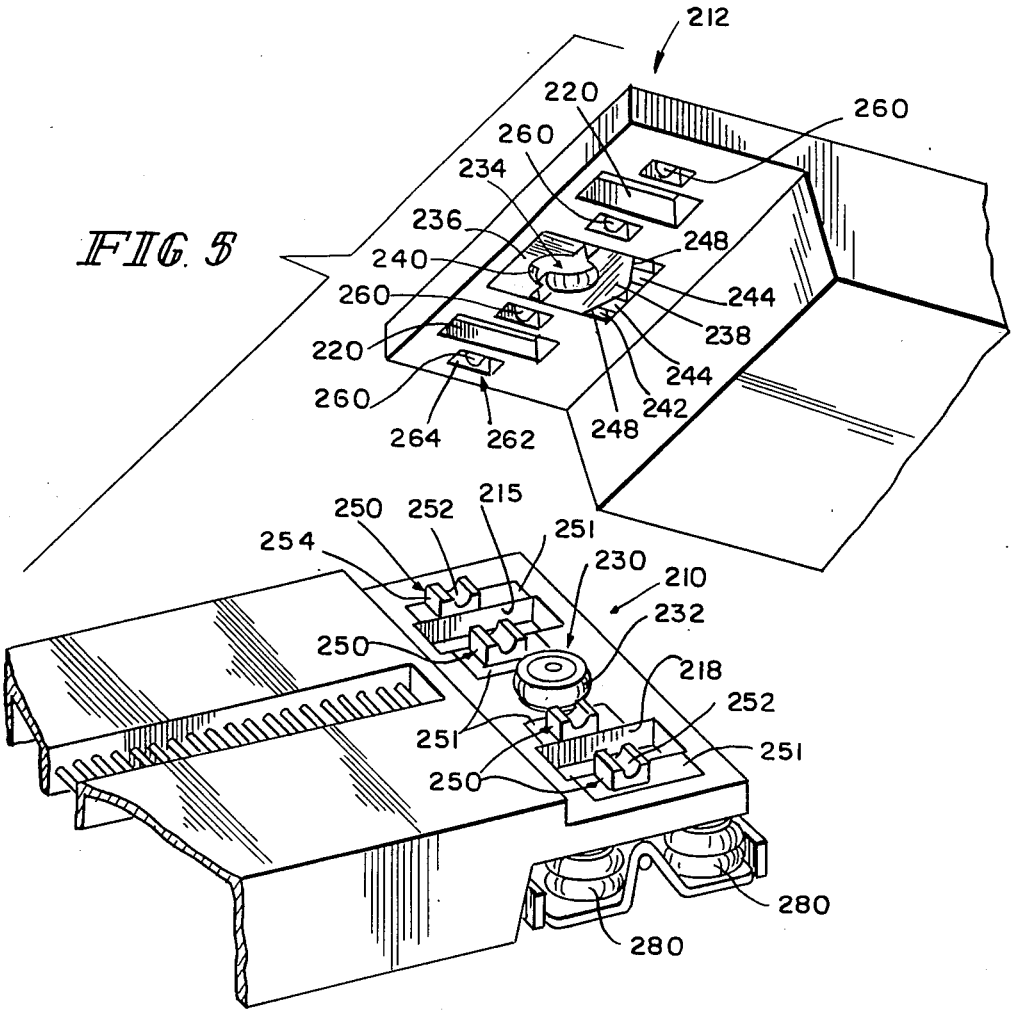
FIG. 5 is an exploded perspective view of an articulated coupling incorporating the principles of the present invention.
Figure 6:
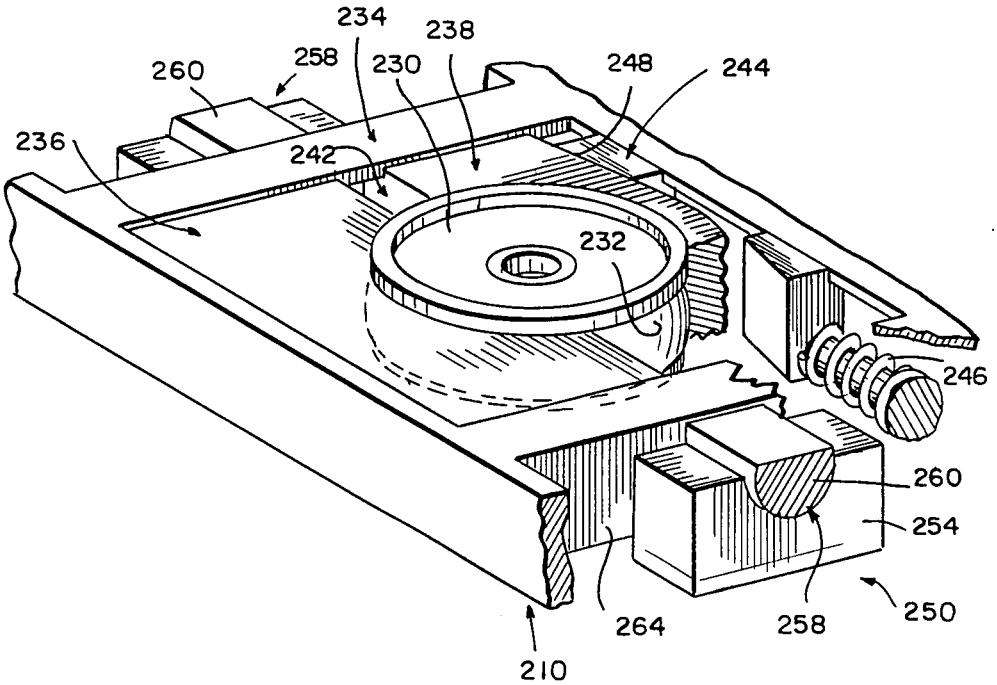
FIG. 6 is a cutaway partial perspective view of the articulated coupling.
Figure 7:
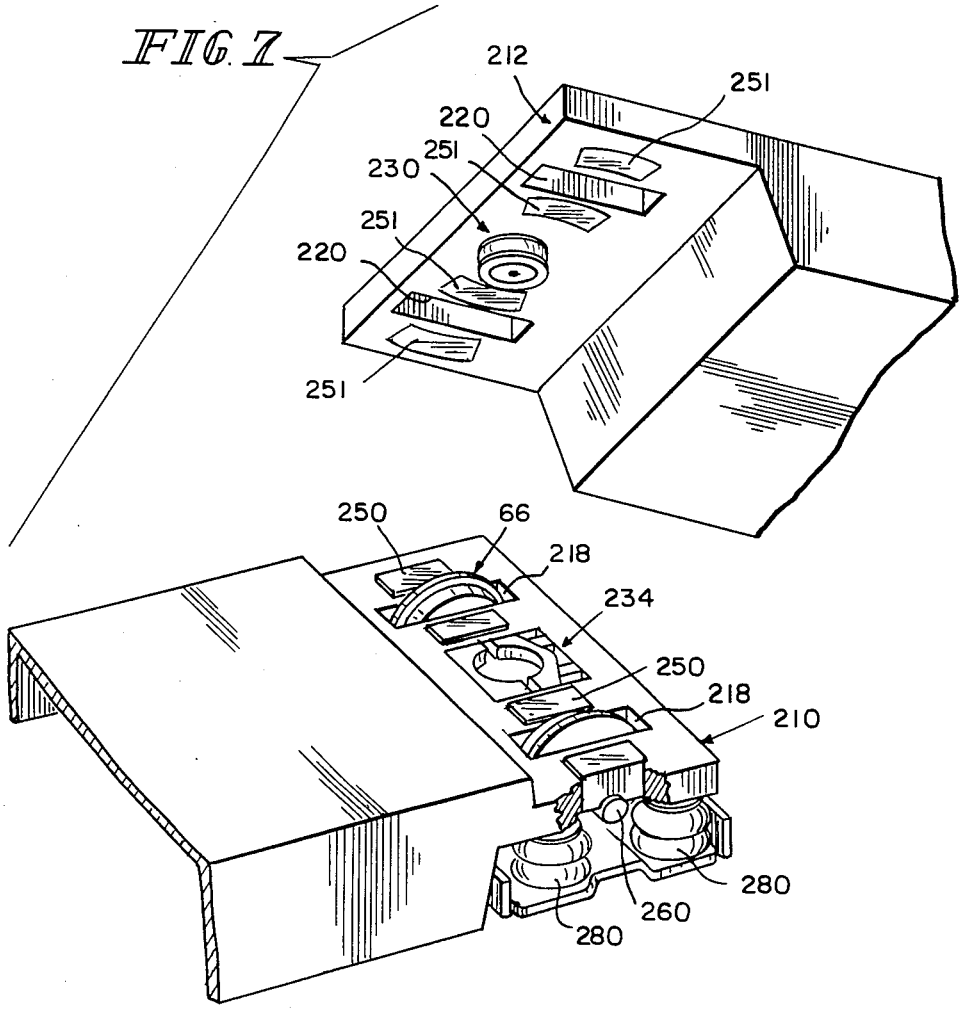
FIG. 7 is an exploded perspective view of another embodiment of an articulated coupling incorporating the principles of the present invention.

The details of articulated couplings which allows or facilitates the two adjacent cars joined over a single axle to accommodate yaw and pitch while limiting roll is illustrated specifically in FIGS. 5, 6 and 7. Functionally, the coupling is a plural point coupling along the lateral axis of one of the two cars which allows the axis of the coupling to follow the lateral axis of one end of the car when it deviates angularly from the lateral axis of its mate when rounding a curve. Each coupling includes a male and female member. The center coupling facilitates rotation about a vertical axis at the longitudinal axis of the car to allow yaw. The relationship of the male and female members of the couplings being matching concave and convex surfaces to facilitate rotation about the lateral axis which facilitates pitch. The plural point coaxial couplings limit roll by incorporating the stiffness of the deck construction. The articulated coupling will be described as including a center coupling and plural side bearings or couplings to accomplish the stated operations.

In the embodiment of FIGS. 5 and 6 the center coupling includes a male member 230 having convex surface 232 which is a section of a sphere, mounted at the longitudinal axis of car 30 at the wheeled end 210 to define a vertical axis of rotation. The radius of 232 is selected as large as possible to reduce the stress of the coupling. The female member 234 of the center coupling includes two half collars 236 and 238, each having a concave surface 240 which complements the convex surface 232 of the female member in a recess 242 of the wheelless end 212. Whereas collar 236 is fixed to the frame, collar 238 moves along the longitudinal axis of the body in a track in the recess 242. A pair of wedges 244 are biased laterally by spring 246 to engage rear surface 248 of the movable collar 238 to bias it longitudinally toward fixed collar 236. The angle of the wedge is in the range of 4½ to 9 degress from the lateral axis to control the mechanical advantage of springs. Thus the springs bind the half collar from opening when the forces produced by slack action are imposed, but do not close it so tight as to cause excessive wear on their own account.

The mating spherical shape of surfaces 236 and 240 allows pivotal motion about any axis at the longitudinal axis of the body. The radius of the spherical surfaces or the horizontal diameters is selected to be as large as practical to distribute the load and restrict motion primarily to rotation about a vertical axis. Rotation about the longitudinal axis is restricted by the coupling, while rotation about the lateral axis is permitted by movement of the spring biased collar 238. The movable collar 238 is also self-compensating for wear.

The four side bearings include a male member 250 having a concave surface 252 and lateral faces 254. The female member 258 of the side bearings includes a cylindrical member 260 mounted between the lateral faces 264 of recess 262 of the wheelless side 212 of the adjacent car. The four female cylindrical members 260 are coaxial with each other and the center of the sphere of the center coupling 230 to define the lateral axis about which the couplings rotate. The male members 250, which move relative to the top surface of the wheeled end 210 have bearing surfaces therebetween to facilitate the relative movement. At a minimum, the top surface of the wheeled end 210 is treated with a material or wear plate to reduce the friction in the anticipated arcuate path of the male members 250. A plate 251 is illustrated as mounted to the surface of wheeled end 210. Since the male members 250 freely move on the wheeled end 210 instead of riding in arcuate recesses, they do not restrict or bind the movement of the side bearings in the horizontal plane of the car.

As will be noted, the female members 260 are firmly affixed to the wheelless end 212 of one car whereas the male members 250 move relative to the wheeled end 210 of the adjacent car. The spacing between the opposed faces 254 of the male member and opposed faces 264 of the female member allow alignment of the male members to the female members as the female members are lowered down onto the male members.

The location of the male and female members of the bearings and couplings may be reversed as illustrated in FIG. 7. The wheelless end 210 includes the male members 230 of the center coupling and wear plates 251. The wheeled end 210 includes the female members 234 of the center coupling and female members 260 of the side bearings 250. The male members 250 of the side bearings 250 are placed in recess 262 to provide a top bearing surface raised above the surface of the wheeled end 210 on which the wear plates 251 of the wheelless end 212 moves. The embodiment of FIG. 7 is advantageous since the cylindrical interacting surfaces of the side bearings are not exposed in the decoupled condition. If they were, the surfaces will not collect dirt since the concave surface 252 of the male member 250 faces down. By placing the bearing surfaces 251 above the male members 250, no dirt will collect on these interacting surfaces either.

A third alternative, which is not illustrated, is to provide the male members of the center coupling at a different end of the car than the male member of the side bearings. The important relationship which must be maintained is that the horizontal, lateral axis of the female members 260 of the side bearings are coaxial with the center of the sphere defined by the center coupling.

As can be seen, the couplings are mating surfaces with no latches or fasteners except the biased female collars 236 and 238 and are coupled and decoupled by vertical movement. No pins are used as in the prior art couplings which require horizontal movement for coupling and decoupling. The present coupling is decoupled manually by slacking off the wedges, and moving the collar 238 and raising the top car. Longitudinal stress do not effect the coupling or decoupling procedure since no vertical pin is used.

By providing the complementary concave and convex surfaces and the plural point articulated coupling along the lateral axis, the mated ends of the wheeled and wheelless ends of the cars facilitate pitch variations or rotation about the coaxial lateral axis of the male and female couplings. Similarly, with the center coupling 230 pivotally connected at the longitudinal axis of the car and the sliding side coupling members 250 following an arcuate path, the coupling facilitates yaw or rotation about the vertical axis at the longitudinal axis of the car. By providing a plural point coupling and bearings themselves along the lateral axis of the car bodies, roll or rotation about the longitudinal axis of the body is substantially eliminated. Since the two ends 210 and 212 of the adjacent cars intersect at a plurality of points displaced along the lateral axis, any rotation about the longitudinal axis is transferred to the two interconnected bodies and is resisted by the torsional strength of the body structure. To maximize the roll resistance, the couplings traverse a substantial portion of the width of the body. Thus, roll is resisted by the articulated coupling as well as the structure of the car body. Any variation in the height of the car bodies from the road are compensated by the suspension system which include air bags 280 as to be described below.

The extruded deck elements being hollow provides the insertion of the electrical as well as fluid conduits therethrough. Brake pipe 92 and main reservoir pipe 94 and cable 82 for the car status indicator and the control cab to control cab communication are provided within the deck 200. Also provided in the deck of the first and last five cars of each section are the three phase power cables 56 and the transmission control cable 70. Pipes 92 and 94 and conduits for the coaxial cables would be formed in the deck with actual pipes being plastic tubing with replaceable fittings at each end. The actual joint would be bridged by flexible reinforced hoses at each articulation. Coaxial electric connectors would also be provided at the joints.

Figure 8:
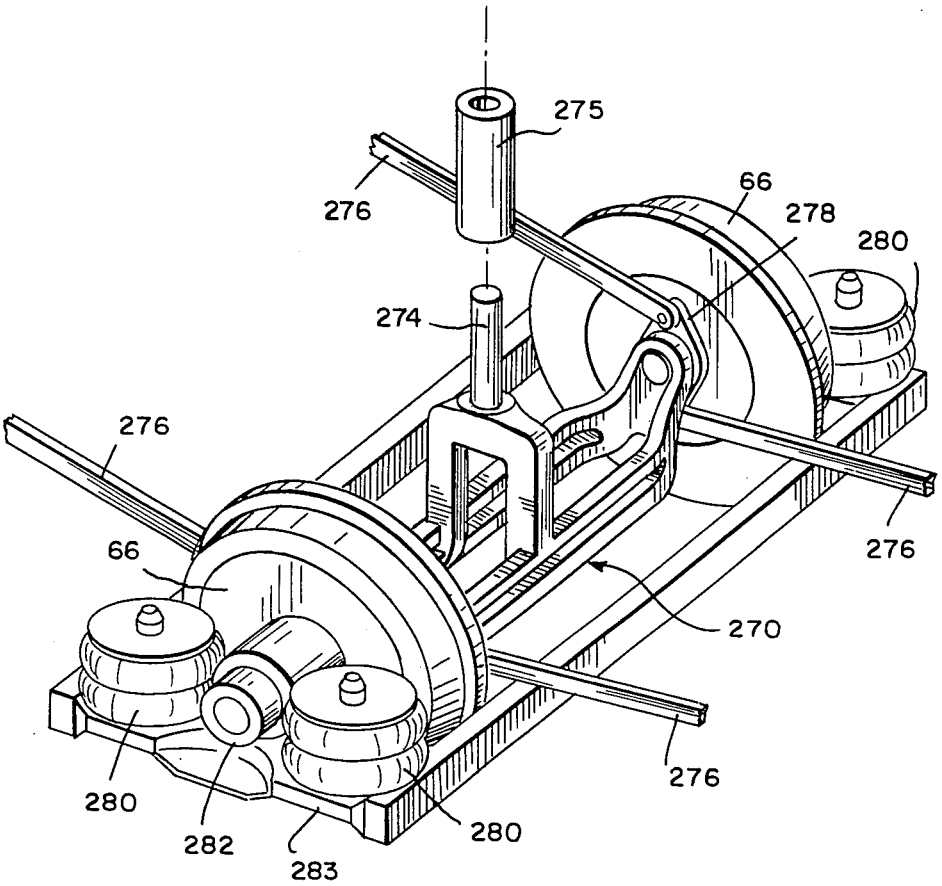
FIG. 8 is a perspective view of a non-driven axle assembly incorporating the principles of the present invention.

The axle assembly as illustrated in FIG. 8 includes a single drop center, non-rotating axle 270 with independent wheel bearings coaxially projecting from the edge thereof. The center of the forged axle 270 is dropped relative to the coaxial bearings. A swivel pin 274 connects the axle to the frame of wheeled end 210 at bushing 275 independently of the articulated coupling which interconnects adjacent cars. For the power driven cars, the differential is mounted to the center of the axle 270 and the swivel pin 274 extends from the differential housing. Links 276 connect the centering levers 278 at each end of the axle to both of the adjacent cars. The swiveling of the axle 270 is guided by the centering levers 278 and links 276 such that when the car rounds a curve, the axle is always taking a position bisecting the angle made by the two adjacent cars.

The suspension includes the air springs 280 mounted between the underframe and bearing saddles 283 straddling the rotating stubs 282 protruding from each wheel. The entire axle swivels beneath the car and the longitudinal displacement of the axle is accepted by the air spring 280 being deflected, thus, vertical suspension and axle swivel are both taken by the air springs 280. Lateral motion of the car is transmitted to the rails by both deflection of the air springs 280 and deflection of the rubber car body center pin bushing 275 which acts as an elastomeric lateral stop.

Although many systems are discussed above in connection with an intermodal integral train, they are equally applicable to other integral trains and even non-integral trains. Similarly, the use of male and female, with respect to the couplings and bearings, are to distinguish the mating members and are to have no other significance.

From the preceding description of the preferred embodiments, it is evident that the objects of the invention are attained, and although the invention has been described and illustrated in detail, it is to be clearly understood that the same is by way of illustration and example only and is not to be taken by way of limitation. The spirit and scope of the invention are to be limited only by the terms of the appended claims.

What is claimed is:

1. An articulated coupling for a rail car having a body with first and second ends, and an axle mounted to said body at said first end, comprising:

first coupling means including a pair of members, one member of said pair on each end of said body on the longitudinal axis of said body which when mated with a respective member of another car define a vertical axis of rotation at a central longitudinal axis of said body;

second and third coupling means each including a pair of members, one member of each pair associated with each end of said body, separated from each other along a lateral axis of said body including therebetween said first coupling means and which when mated with a respective member of another car define a lateral axis of rotation which intersects said vertical axis of rotation at said first coupling means;

wherein said second and third coupling means each include a cylindrical female member coaxial with said lateral axis of said body, mounted at one end of said body and a concave male member associated with the other end of said body for receiving a respective female member of an adjacent car;

members of said first, second and third coupling means associated with said first end of said rail car mating with members of first, second and third coupling means associated with said second end of an adjacent car for facilitating pivoting about said vertical axis at said first coupling means, facilitating pivoting about said lateral axis at said first, second and third coupling means and restricting pivoting about said longitudinal axis.

2. An articulated coupling according to claim 1, including first mounting means for maintaining said female members coaxial with said lateral axis, and second mounting means for allowing said male members to move and be coaxial with the axis of the mating female members of an adjacent car.

3. An articulated coupling according to claim 2, including means for maintaining said male members coaxial along an axis parallel to the axis of said female members of an adjacent car during the mating of said male and female members.

4. An articulated coupling according to claim 3, wherein said maintaining means includes a pair of side faces on said concave male members spaced along said lateral axis, and a pair of side faces on said female member spaced along said lateral axis and said cylindrial female member extending from said side faces, said side faces of said male and female members engage during mating to align said male members to a mating female member.

5. An articulated coupling according to claim 1, wherein said male members include a bearing surface for engaging and moving on its associated end of said body.

6. An articulated coupling according to claim 1, wherein said first coupling means includes a male member being at least a portion of a sphere at said other end of said body and a female member having an aperture whose sides are at least portions of a sphere and whose axis is coaxial with said vertical axis.

7. An articulated coupling according to claim 6, including first mounting means for maintaining said female members coaxial with said lateral axis, and second mounting means for allowing said male members of said second and third coupling means to move on said body and be coaxial with the axis of the mating female members of an adjacent car.

8. An articulated coupling according to claim 1, including fourth and fifth coupling means each including a pair of members, one member of each pair associated with each end of said body, separated from each other and said first, second and third coupling means, along said lateral axis of said body.

9. An articulated coupling according to claim 1, wherein said first coupling means includes a male member and a female member, for receiving said male member.

10. An articulated coupling according to claim 9, including means for mounting said male members of said second and third means to said first end of said body to move relative thereto and means for fixedly mounting said female members of said second and third means to said second end of said body.

11. An articulated coupling according to claim 10, wherein said second end of said body is wheelless.

12. An articulated coupling according to claim 10, including means for pivotally mounting said axle to said first end of said body.

13. An articulated coupling according to claim 12, including an air bag at each end of said axle for allowing vertical variations between said axle and said body.

14. An articulated coupling according to claim 9, including means for mounting said male members of said second and third means to said second end of said body to move relative thereto and means for fixedly mounting said female members of said second and third means to said first end of said body.

15. An articulated coupling according to claim 1, wherein said first coupling means includes a male member being at least a portion of a sphere at one end of said body and a female member having an aperture whose sides are at least portions of a sphere and whose axis is coaxial with said vertical axis at the other end of said body.

16. An articulated coupling according to claim 15, wherein said female member includes a first and second female portion having opposed semi-spherical walls for receiving said male member therebetween, said first female portion being fixed to said body, means for mounting said second female portion to move along said longitudinal axis for facilitating pivoting about said lateral axis.

17. An articulated coupling according to claim 16, including means for biasing said second female portion toward said first female portion.

18. An articulated coupling according to claim 1, including means for pivotally mounting said axle to said body, and a pair of air bags at each end of said axle for allowing vertical and horizontal variations between said axle and said body.

19. An articulated coupling according to claim 1, wherein said body includes a plurality of longitudinal planks welded together and plates welded to the top of said planks.

20. An articulated coupling for a rail car having a body with first and second ends, and an axle mounted to said body at said first end, comprising:

first coupling means including a pair of members having complementary spherical surfaces, one member of said pair on each end of said body on the longitudinal axis of said body;

second and third coupling means each including a pair of members having concave and convex complementary cylindrical surfaces which have axes parallel to a lateral axis of said body, one member of each pair associated with each end of said body, separated from each other along said lateral axis of said body including therebetween said first coupling means;

the axes of said cylindrical surfaces of said second and third coupling means being coaxial and include the center of said spherical surfaces of said first coupling means when mated.

21. An articulated coupling according to claim 20, wherein said first coupling means includes a male member being at least a portion of a sphere at one end of said body and a female member having an aperture whose sides are at least portions of a sphere and whose axis is coaxial with said vertical axis at the other end of said body.

22. An articulated coupling according to claim 21, wherein said female member includes a first and second female portion having opposed semi-spherical walls for receiving said male member therebetween, said first female portion being fixed to said body, means for mounting said second female portion to move along said longitudinal axis for facilitating pivoting about said lateral axis.

23. An articulated coupling according to claim 22, including means for biasing said second female portion toward said first female portion.

24. An articulated coupling according to claim 20, wherein said second and third mounting means each include a cylindrical female member mounted at one end of said body and a concave male member associated with and movable on the other end of said body for receiving a respective female member of an adjustment car.

25. An articulated coupling for a rail car having a body with first and second ends, and an axle mounted to said body at said first end, comprising:

first coupling means including a pair of members, one member of said pair on each end of said body on the longitudinal axis of said body;

second and third coupling means each including a pair of members, one member of each pair associated with each end of said body, separated from each other along a lateral axis of said body including therebetween said first coupling means;

members of said first, second and third coupling means associated said first end of said first end of said rail car mating with members of first, second and third coupling means associated with said second end of an adjacent car for facilitating pivoting about a vertical axis at said first coupling means, facilitating pivoting about said lateral axis at said first, second and third coupling means and restricting pivoting about said longitudinal axis;

wherein said second and third coupling means each include a cylindrical female member coaxial with said lateral axis of said body mounted at one end of said body and a concave male member associated with the other end of said body for receiving a respective female member of an adjacent car; and wherein said male members and corresponding female members have the same length along said lateral axis.

26. An articulated coupling for a rail car having a body with first and second ends, and an axle mounted to said body at said first end, comprising:

first coupling means including a pair of members, one member of said pair on each end of said body on the longitudinal axis of said body;

second and third coupling means each including a pair of members, one member of each pair associated with each of said body, separated from each other along a lateral axis of said body including therebetween said first coupling means;

members of said first, second and third coupling means associated said first end of said first end of said rail car mating with members of first, second and third coupling means associated with said second end of an adjacent car for facilitating pivoting about a vertical axis at said first coupling means, facilitating pivoting about said lateral axis at said first, second and third coupling means and restricting pivoting about said longitudinal axis;

including fourth and fifth coupling means each including a pair of members, one member of each pair associated with each end of said body, separated from each other and said first, second and third coupling means, along said lateral axis of said body; and wherein said second, third, fourth and fifth coupling means each include a cylindrical female member coaxial with said lateral axis of said body at one end of said body and a concave male member associated with the other end of said body for receiving a respective female member of an adjacent car.

27. An articulated coupling according to claim 1, including an elastic bushing pivotally mounting said axle to said body at said vertical axis.

28. An articulated coupling according to claim 20, including an elastic bushing pivotally mounting said axle to said body at said center of said spherical surfaces.

* * * * *